US005147090A

United States Patent [19]

Mandell et al.

[11] Patent Number: 5,147,090

[45] Date of Patent: Sep. 15, 1992

[54] WRIST AND FOREARM SUPPORT AND REST APPARATUS FOR USE WITH KEYBOARDS AND THE LIKE

[76] Inventors: Sandra Mandell, 35 Gabriel Dr., Montville, N.J. 07045; Madge W. Weiss, 556 Eagle Rock Ave., Roseland, N.J. 07068

[21] Appl. No.: 787,517

[22] Filed: Nov. 4, 1991

[51] Int. Cl.[5] ..... B43L 15/00

[52] U.S. Cl. ..... 248/118.1; 248/910; 248/346; 248/558

[58] Field of Search ..... 248/118, 118.1, 118.3, 248/118.5, 224.3, 224.4, 910, 346, 291, 242, 558, 454; 297/411, 415; 400/715

[56] References Cited

U.S. PATENT DOCUMENTS

| | | | |
|---|---|---|---|
| 1,179,536 | 4/1916 | Lyman | 248/558 X |
| 2,950,890 | 8/1960 | Hough, Jr. | 248/118 |
| 3,415,177 | 10/1968 | Abramowitz et al. | 248/346 X |
| 4,482,064 | 11/1984 | Berke et al. | 248/118 X |
| 4,545,554 | 10/1985 | Latino et al. | 248/118.1 |
| 4,621,781 | 11/1986 | Springer | 248/118 |
| 4,973,176 | 11/1990 | Dietrich | 248/118 X |
| 5,040,757 | 8/1991 | Benaway | 248/118.3 |
| 5,050,826 | 9/1991 | Johnston | 248/118.3 |
| 5,072,905 | 12/1991 | Hyatt | 248/118 |

FOREIGN PATENT DOCUMENTS

| | | | |
|---|---|---|---|
| 42022 | 10/1965 | Fed. Rep. of Germany | 248/118 |

*Primary Examiner*—Karen J. Chotkowski
*Attorney, Agent, or Firm*—Anthony F. Cuoco

[57] ABSTRACT

Apparatus for supporting and resting the wrists and forearms of an operator of a keyboard such as associated with a computer or word processor or the like so as to reduce wrist and arm fatigue and cumulative trauma due to extended operation of the keyboard. An operator's wrists are supported in a position whereby the hands are comfortably free for operating the keyboard and rest on a wrist rest. The operator's forearms rest on forearm rests which overhang a work surface, with said forearm rests being adjustably positioned for the convenience of the operator.

11 Claims, 1 Drawing Sheet

WRIST AND FOREARM SUPPORT AND REST APPARATUS FOR USE WITH KEYBOARDS AND THE LIKE

BACKGROUND OF THE INVENTION

This invention relates to apparatus for supporting and resting the wrists and forearms of an operator of a keyboard such as associated with a computer, word processor, and the like. More particularly, this invention relates to apparatus of the type described which reduces wrist and forearm fatigue and the cumulative trauma resulting therefrom due to extended operation of the keyboard.

The operation of a computer keyboard and the like over extended periods of time involves the muscles of the hands, wrists, forearms and shoulders. Since the entire described bodily extremity is generally suspended without support, great physical strain of the hands, arms and shoulders, and even the back, of an operator may result. Without proper support of the arms, wrists or hands, premature fatigue and reduced productivity may occur. Further, it has recently been determined that improper support or positioning of the arms, wrists or hands in front of the keyboard over long periods of time may increase the likelihood of the operator acquiring painful and debilitating conditions, among which is Carpal Tunnel Syndrome.

Various prior art devices have attempted to provide necessary support and rest apparatus to avoid the aforementioned problems. The applicants are aware of several patents directed to this effort.

U.S. Pat. No. 399,266 which issued to Hull on Mar. 12, 1889 (no designated class) relates generally to a hand rest which includes notches for being supported by an open drawer on a work surface.

U.S. Pat. No. 4,621,781 which issued to Springer on Nov. 11, 1986 (U.S. Class 248/118) relates to an ergonomic forearm rest which tends to alleviate tension and stress in the upper arms and shoulders of an operator involved in interrupted keyboard operations, such as waiting for computer operation.

U.S. Pat. No. 4,973,176 which issued to Dietrich on Nov. 27, 1990 (U.S. Class 400/175) relates to a small, portable palm, wrist or forearm support which is particularly suited for users who switch keyboards or the like frequently.

U.S. Pat. No. 4,976,407 which issued to Schwartz, et al on Dec. 11, 1990 (U.S. Class 400/175) relates to an adjustable wrist support requiring a relatively complex mounting mechanism.

U.S. Pat. No. 5,040,757 which issued to Beneway on Aug. 20, 1991 (U.S. Class 248/118.3) relates to an arm, wrist or hand support having a step top surface which permits quick adjustment of the height and distance of a keyboard from a support surface without using any moving mechanical parts.

U.S. Pat. No. RE 33556 which issued to Berke on Mar. 19, 1991 (U.S. Class 211/69.1) as a re-issue of U.S. Pat. No. 4,482,063 relates to a computer terminal support and hand rest interposed between a computer terminal and a computer operator as well as being interposed between the computer terminal and the top of a support surface.

Additionally, the applicants are aware of apparatus manufactured and marketed by LMB Hand Rehab Products, Inc., P.0. Box 1181, San Luis Obispo, Calif. This apparatus purports to provide ergonomic positioning which stabilizes the wrist of an operator and reduces arm fatigue. However, this device is secured to the work surface by rather cumbersome clamping means which can easily interfere with an operator's legs when sitting or standing, as the case may be. Further, this device is not usable with a work surface having a drawer since the clamping means is likely to interfere with the drawer.

While the prior art devices are generally directed to the purposes of the invention herein disclosed, these devices are somewhat cumbersome or difficult to manufacture, and do not easily interface with an operator or a work station. The present invention overcomes these disadvantages.

SUMMARY OF THE INVENTION

This invention contemplates wrist and forearm support and rest apparatus for use with keyboards and the like including a base preferably having a non-skid undersurface which rests on a work surface such as a desk or a table or the like. A wrist support, a wrist rest and a bracket are integral with the base. A pair of forearm rests are removably and adjustably mounted to the bracket and overhang the work surface. The arrangement is such that the forearm rests are mounted so as to be disposed substantially horizontal, or tilted above or below horizontal, as is desireable for the comfort of an operator. The top surface of the base and the bottom surface of a keyboard or the like which is disposed on the base top surface may be removably secured each to the other to prevent relative movement therebetween.

When using the device, an operator supports the wrists on the wrist support in a position so that the hands are comfortably free for operating the keyboard. The wrists rest on the wrist rest and the forearms rest on the forearm rests which are mounted to the bracket in a position according to the convenience of the operator as aforenoted. The base and hence the keyboard, may be positioned on the work surface at an angle to the front edge thereof, as may be desired.

DETAILED DESCRIPTION OF THE INVENTION

Figure 1:
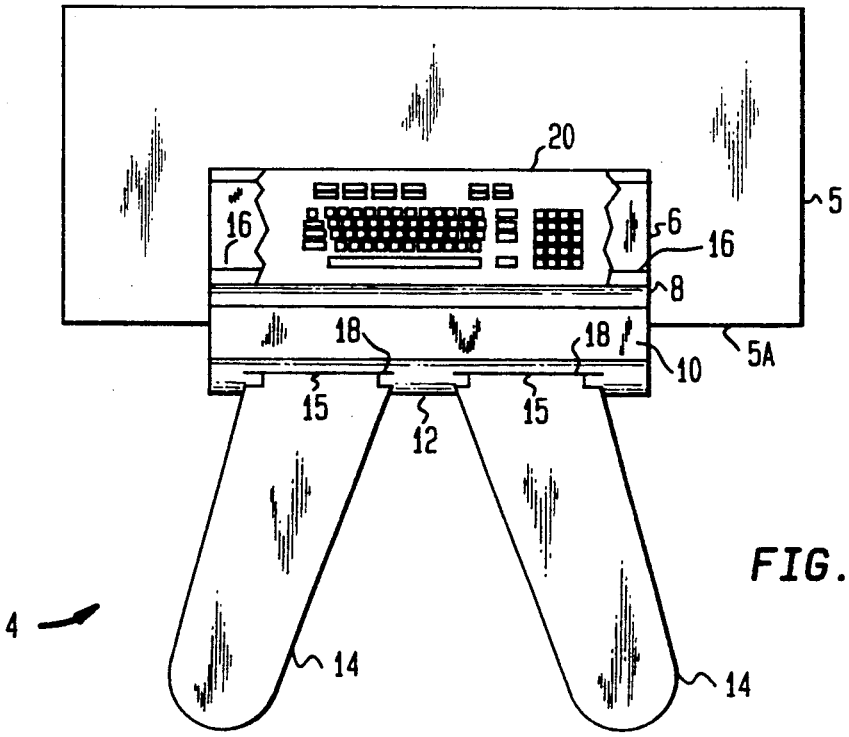
FIG. 1 is a diagrammatic top plan view of apparatus according to the invention.

Support apparatus according to the invention is designated generally by the numeral 4. Support apparatus 4 includes a base 6, preferably having a non-skid undersurface 4A, which rests on a work surface such as a desk or a table or the like 5, with the front of the base near the front edge of the work surface.

Base 6 terminates at its front in a slightly raised, generally arcuately shaped elongated wrist support 8. A correspondingly elongated flat wrist rest 10 is appended to wrist support 8 and slants slightly downwardly and outwardly therefrom. Wrist rest 10 terminates in a correspondingly elongated tubular-like bracket 12. Bracket 12 has mounted thereto a pair of forearm rests 14. Forearm rests 14 extend from bracket 12 in angular spaced relation to each other (FIG. 1) corresponding to the angular spaced relation of the forearms of an operator of a keyboard 20 when operating the keyboard, and overhang the front edge 5A of work surface 5. Keyboard 20 is disposed on base 6.

Figure 2:
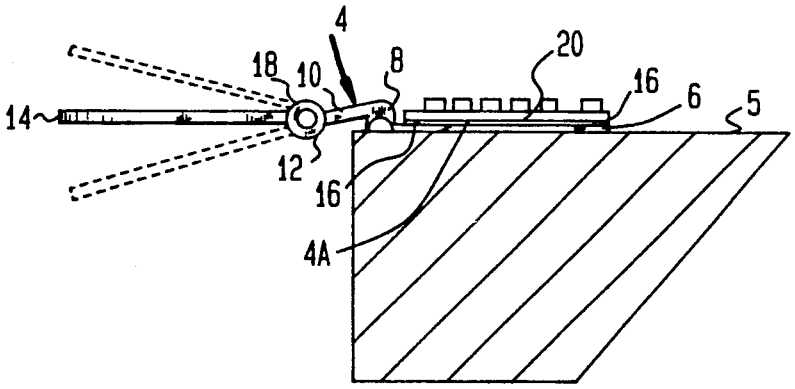
FIG. 2 is a diagrammatic side elevational view of said apparatus.
Figure 3:
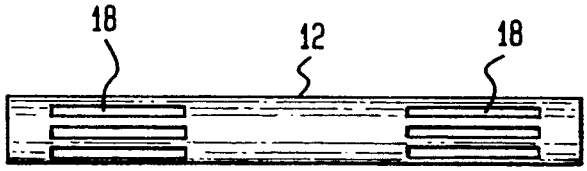
FIG. 3 is a diagrammatic front view of a bracket which is part of the apparatus, and which removably and adjustably supports arm rests which are likewise part of said apparatus.

Forearm rests 14 are adjustably mounted to bracket 12. In this regard, bracket 12 has at least three slots 18 at each end thereof and disposed in corresponding aligned spaced relation around the front circumference of the bracket as particularly shown in FIG. 3. When the forearm rests are disposed in a substantially centrally disposed slot 18 the rests are substantially horizontal. When the forearm rests are supported in an upper slot 18, the rests are slanted slightly upwardly (as shown in phantom in FIG. 2) and when supported in a lower slot 18, are slanted slightly downwardly (as also shown in phantom in FIG. 2). This feature of the invention accommodates adjustably positioning forearm rests 14, as may be desired by an operator from time to time.

The top surface of base member 6 and the bottom surface of keyboard 20 may be removably secured each to the other as by loop and pile fastener strips 16 mounted to the base and keyboard surfaces as by an adhesive to prevent movement of the keyboard on the base.

When using the apparatus disclosed, an operator positions the wrists on wrist support 8 for supporting the hands in a position so as to be comfortably free for operating keyboard 20. With the wrists so positioned, they rest on wrist rest 10 and the operator's forearms rest on forearm rests 14 in angular spaced relation as aforenoted, and in the horizontal position or tilted angularly upwardly or downwardly as described.

It will be understood that support apparatus 4 including members 6, 8, 10 and 12 may be fabricated as a unitary member of a suitable plastic such as polypropylene or the like as by molding, and having an appropriate thickness and rigidity for the intended purposes. In this regard it will be understood that the aforementioned plastic member may be suitably weighted at least in the area of base 6 as by the plastic having a talc content to avoid the up-ending of base 6 and keyboard 20 due to the force exerted by an operator on forearm rests 14. Forearm rests 14 may be like plastic members having ends in cooperative relation with slots 18 in bracket 12 so that rests 14 are removably mounted to member 12 in the desired horizontal or tilted positions as aforenoted. Support apparatus 4 and keyboard 20 may be angularly positioned on work surface 5 relative to the front edge 5A thereof as may be desired by an operator from time to time.

In connection with forearm rests 14 being mounted to bracket 12, reference is made to FIG. 1 wherein the inserted ends of rests 14 carry tabs 15. Tabs 15 are removably inserted in corresponding slots 18. The fit relationship between tabs 15 and slots 18 is such that forearm rest members 14 are retained in slots 18 unless pulled away therefrom as is necessary for mounting the forearm rests in another slot 18 for the purposes described. In this regard it is noted that the width of slots 18 is greater than that of tabs 15. Tabs 15 may thus be pushed along slots 18 to adjust the lateral position of forearm rests 14 to accommodate the needs of a particular operator.

There has thus been described support and rest apparatus for the wrists and forearms of an operator of a keyboard such as associated with a computer or word processor or the like. In the preferred embodiment of the invention, the apparatus is fabricated as a unitary plastic member and the forearm rests are adjustably and removably mounted to said unitary member. The support apparatus may have a non-skid undersurface for resting on a work surface without slipping, and the top surface of the apparatus and the bottom surface of a keyboard used in conjunction therewith may be removably secured to each other as by loop and pile fasteners to prevent movement therebetween. Apparatus according to the invention is simple in construction and easy to use, and serves the purpose of reducing wrist and arm fatigue and cumulative trauma associated with extended operation of a keyboard as is likely to result.

With the above description of the invention in mind, reference is made to the claims appended hereto for a definition of the scope of the invention.

What is claimed is:

1. Wrist and forearm support and rest apparatus for use with keyboards and the like, comprising:

a base having its front disposed near the front edge of a work surface;

a keyboard disposed on top of the base;

said base terminating at its front in an integral slightly raised, generally elongated wrist support;

a correspondingly elongated integral wrist rest appended to the wrist support and slanting slightly downwardly and outwardly therefrom;

said wrist rest terminating in a correspondingly elongated integral bracket;

a pair of forearm rests, each of which is removably and adjustably mounted to the bracket, said forearm rests extending outwardly from the bracket in angular spaced relation to each other corresponding to the angular spaced relation of the forearms of an operator when using the keyboard, and overhanging the front edge of the work surface;

the bracket being a substantially tubular-like member having at least three slots at each end thereof and disposed in corresponding spaced relation around the front circumference of the bracket;

each of the forearm rests having a mounting end, said mounting ends having tabs;

the tabs at the mounting ends of each of the forearm rests being inserted in corresponding slots at each of the ends of the bracket, whereby the forearm rests are mounted to the bracket in a selected position; and the fit relationship between the tabs and the slots is such that the tabs are retained in the slots until pulled away therefrom for removal of the forearm rests from the bracket so that the tabs can be inserted in other corresponding slots in the bracket for mounting the rests thereto in an other selected position.

2. Apparatus as described by claim 1, including:

first means mounted to the top surface of the base;

second means mounted to the bottom surface of the keyboard; and said first and second means cooperating to removably secure the keyboard to the base.

3. Apparatus as described by claim 2, wherein:

the first means includes one member of a loop member and a pile member;

the second means includes the other member of the loop member and the pile member; and said loop and pile members being in cooperative engagement to removably secure the keyboard to the base.

4. Apparatus as described by claim 1, wherein:

the slots in each end of the bracket are disposed in corresponding spaced relation around the front circumference of the bracket so that a first of the slots is substantially centrally disposed, a second of the slots is aligned with and disposed above the first slot and a third of the slots is aligned with and disposed below the first slot; and the tabs at the mounting ends of the forearm rests are inserted in the first slots so that the rests extend outwardly and substantially horizontally from the bracket in a first selected position, are inserted in the second slots so that the rests extend outwardly and slant upwardly from the horizontal in a second selected position, and are inserted in the third slots so that the rests extend outwardly and slant downwardly from the horizontal in a third selected position.

5. Apparatus as described by claim 1, wherein:

the base has a non-skid undersurface, whereby the base rests on the work surface without slipping.

6. Apparatus as described by claim 1, wherein:

the slots wider than the tabs so that the tabs can be displaced along the slots to adjust the lateral position of the forearm rests.

7. Apparatus as described by claim 1, wherein:

at least the base is weighted to avoid the up-ending of said base due to a force exerted by the operator on the forearm rests.

8. Wrist and forearm support and rest apparatus for use with keyboards and the like, comprising:

a base having its front disposed near the front of a work surface and having a non-skid undersurface for inhibiting movement of said base on said work surface;

said base terminating at its front in an integral slightly raised, generally elongated wrist support;

a correspondingly elongated integral wrist rest appended to the wrist support and slanting slightly downwardly and outwardly therefrom;

said wrist rest terminating in a correspondingly elongated integral bracket;

keyboard disposed on top of the base;

one member of a loop member and a pile member mounted to the bottom surface of the keyboard;

the other member of the loop member and pile member mounted to the top surface of the base;

said loop and pile members being in cooperative engagement to removably secure the keyboard to the base;

the bracket being a substantially tubular-like member having at least three slots at each end thereof and disposed in corresponding spaced relation around the front circumference of said bracket;

a pair of forearm rests, each of which has a mounting end, said mounting ends having tabs;

the tabs at the mounting ends of each of the forearm rests being inserted in corresponding slots at each of the ends of the bracket, whereby the forearm rests are mounted to the bracket in a selected position, with said forearm rests overhanging the front edge of the work surface; and the fit relationship between the tabs and the slots being such that the forearm rests are retained on the bracket until pulled away therefrom for removal of the rests from the bracket so that the tabs can be inserted in other corresponding slots in the bracket for mounting the rests thereto in an other selected position.

9. Apparatus as described by claim 8, wherein:

the slots in each end of the bracket are disposed in corresponding spaced relation around the front circumference of the bracket so that a first of the slots is substantially centrally disposed, a second of the slots is aligned with and disposed above the first slot and a third of the slots is aligned with and disposed below the first slot; and the tabs at the mounting ends of the forearm rests are inserted in the first slots so that the rests extend outwardly and substantially horizontally from the bracket in a first selected position, are inserted in the second slots so that the rests extend outwardly and slant upwardly from the horizontal in a second selected position, and are inserted in the third slots so that the rests extend outwardly and are tilted downwardly from the horizontal in a third selected position.

10. Apparatus as described by claim 8, wherein:

the slots are wider than the tabs so that the tabs can be displaced along the slots to adjust the lateral position of the forearm rests.

11. Apparatus as described by claim 8, wherein:

at least the base weighted to avoid the up-ending of said base due to a force exerted by the operator on the forearm rests.

* * * * *